US007051384B1

(12) United States Patent
Guillot et al.

(10) Patent No.: US 7,051,384 B1
(45) Date of Patent: May 30, 2006

(54) FOLDABLE BED WITH FOLDABLE GUARDRAIL

(75) Inventors: Edmond Paul Guillot, Conover, NC (US); William Charles Hiatt, Fort Smith, AR (US); Max Dene Richards, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 0 days.

(21) Appl. No.: 10/981,023

(22) Filed: Nov. 4, 2004

(51) Int. Cl.
*A47C 19/00* (2006.01)
*A47C 21/00* (2006.01)

(52) U.S. Cl. ..... 5/9.1; 5/430; 5/425

(58) Field of Classification Search ..... 5/9.1, 5/430, 425, 428, 411
See application file for complete search history.

(56) References Cited

U.S. PATENT DOCUMENTS

| | | | | | |
|---|---|---|---|---|---|
| 1,195,637 | A | | 8/1916 | Anderson | |
| 1,349,962 | A | * | 8/1920 | Janson et al. | 5/9.1 |
| 1,575,241 | A | | 3/1926 | Williams | |
| 2,528,307 | A | * | 10/1950 | Heaney | 5/9.1 |
| 2,705,331 | A | * | 4/1955 | Cone | 5/9.1 |
| 2,708,755 | A | | 5/1955 | Wilkinson, Jr. | 5/8 |
| 2,953,792 | A | | 9/1960 | Fleischer | 5/9 |
| 3,070,813 | A | | 1/1963 | Nyman | 5/9 |
| 3,311,932 | A | * | 4/1967 | Ahola | 5/9.1 |
| 3,316,563 | A | | 5/1967 | Vogel | 5/9 |
| D217,704 | S | | 6/1970 | Ruben | D5/4 |
| 3,877,086 | A | | 4/1975 | Bue et al. | 5/9 R |
| 4,084,276 | A | | 4/1978 | Trexler, Jr. et al. | 5/118 |
| 4,103,373 | A | | 8/1978 | Luedtke et al. | 5/166 R |
| 4,179,763 | A | | 12/1979 | Echavarren et al. | 5/8 |
| 4,218,793 | A | | 8/1980 | Hooker | 5/8 |
| 4,221,012 | A | * | 9/1980 | Harris | 5/430 |
| 4,458,371 | A | * | 7/1984 | Whitehead | 5/200.1 |
| 4,896,385 | A | * | 1/1990 | Bustos | 5/9.1 |
| 5,875,502 | A | | 3/1999 | Kolbenstetter et al. | 5/136 |

* cited by examiner

*Primary Examiner*—Alexander Grosz
(74) *Attorney, Agent, or Firm*—Kennedy Covington Lobdell & Hickman, LLP

(57) ABSTRACT

A foldable bed comprising a frame for supporting a mattress, foldable between a sleeping position and a storage position, and a guardrail in hinged connection with the frame for pivoting movement of the guardrail relative to the frame between an upright guard position wherein the guardrail is angularly oriented relative to the frame and a nested position wherein the guardrail is in flush abutment with the frame. The guardrail may have a mounting tab and a slot in the frame for insertion of the mounting tab of the guardrail into the frame for pivoting movement of the guardrail relative to the frame between an upright guard position wherein the guardrail is angularly oriented relative to the frame and a nested position wherein the guardrail is in flush abutment with the frame.

21 Claims, 5 Drawing Sheets

FOLDABLE BED WITH FOLDABLE GUARDRAIL

FIELD OF THE INVENTION

The present invention relates to a foldable bed having a foldable guardrail, in particular a foldable bunk bed with a foldable guardrail.

BACKGROUND OF THE INVENTION

There is often a need for a bed with a guardrail particularly when safety is a consideration. For example, beds occupied by small children or infirm persons may require a guardrail to prevent such person from rolling or falling out of bed. This is of particular concern when the bed is elevated. Therefore, guardrails are particularly advantageous on an elevated bed such as a bunk bed. It could be dangerous if a person were to fall or roll out of the upper bed of a bunk bed.

There is also a need for a bed that can be used but also folded and stored in a confined space. For example, dorm rooms, military barracks, prisons, boats, and recreational vehicles are just a few examples where sleeping quarters are needed yet the space available for such sleeping quarters is limited.

However, to date, there has not been a bed that is capable of addressing all of these needs.

SUMMARY OF THE INVENTION

The present invention provides a foldable bed comprising a frame for supporting a mattress, foldable between a sleeping position and a storage position, and a guardrail in hinged connection with the frame for pivoting movement of the guardrail relative to the frame between an upright guard position wherein the guardrail is angularly oriented relative to the frame and a nested position wherein the guardrail is in flush abutment with the frame.

The foldable bed may comprise a guardrail having a mounting tab and a slot in the frame for insertion of the mounting tab of the guardrail into the frame for pivoting movement of the guardrail relative to the frame between an upright guard position wherein the guardrail is angularly oriented relative to the frame and a nested position wherein the guardrail is in flush abutment with the frame.

The foldable bed may comprise a single bed frame or multiple bed frames. A foldable bed having multiple bed frames such as a bunk bed is particularly preferred such that it can be used in confined spaces.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENTS

Referring to the accompanying drawings, the present invention is illustrated and hereinafter described with respect to the following preferred embodiment. However, it is to be understood that the present invention may be applied, without departing from the substance or scope of the present invention. Therefore, the present invention should be viewed as being of broad utility unrestricted to the specific construction and uses herein described.

Figure 1:
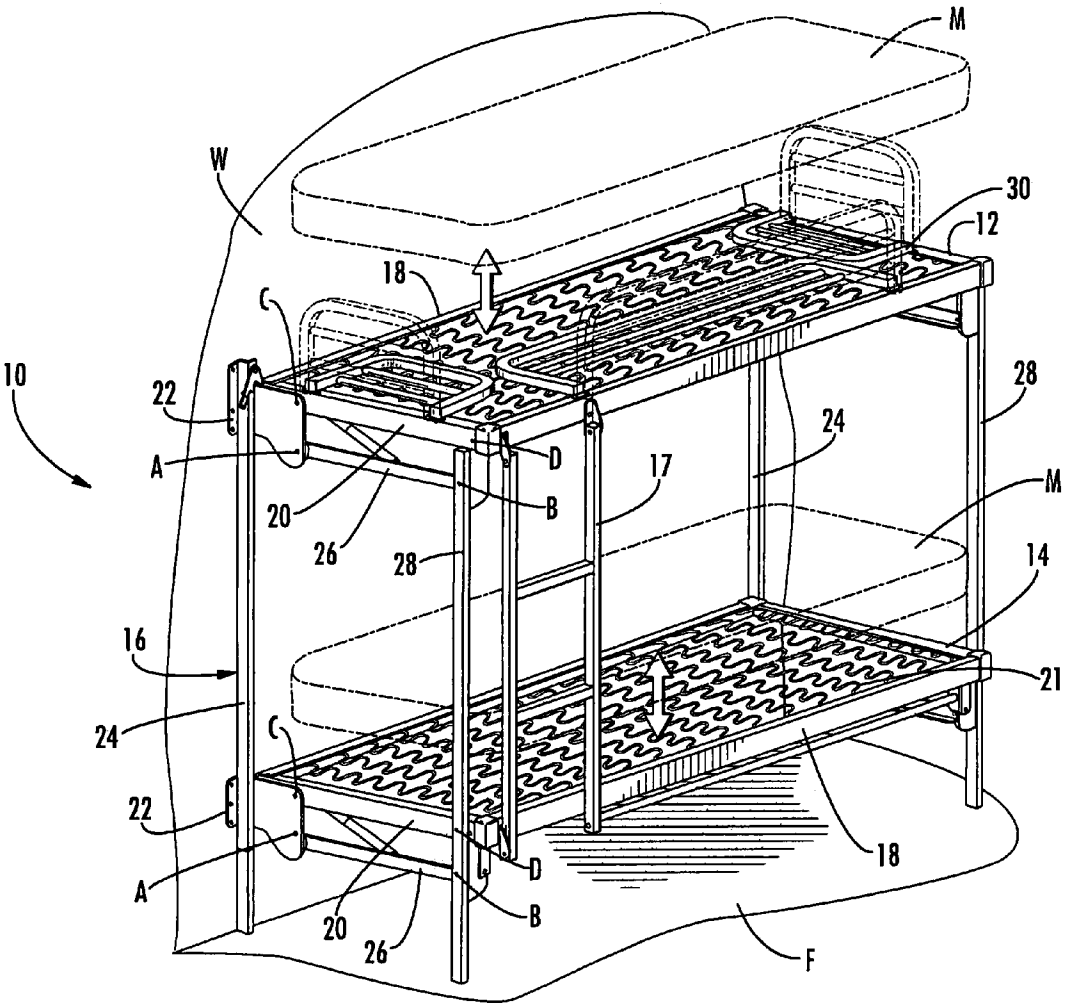
FIG. 1 is a perspective view of a foldable bed with a guardrail, in particular a bunk bed, in accordance with the present invention.

The foldable bed of the present invention is illustrated in FIG. 1 in a bunk bed structure 10 having an upper bed frame 12 and a lower bed frame 14. Each of the upper bed frame 12 and the lower bed frame 14 comprises bed rails. The bed rails comprise a pair of side rails 18 and end rails 20 affixed together in a rectangular orientation together with a plurality of sinuous springs 21 extending laterally between the side rails 18, all of which collectively form a support surface for the mattress M. A ladder 17 typically hangs from the upper bed frame 12 of the bunk bed structure 10 to provide access thereto.

Bunk bed structure 10 and wall W are interconnected pivotably with one another by a pair of mounting structures, referred to individually as mounting structure 16. Each mounting structure 16 includes a pair of wall mounting brackets 22 adapted to be mounted or screwed fixedly to wall W in spaced rectangular relation. A pair of support rails 24 extend in upright relation immediately adjacent to wall W and are rigidly affixed to the respective wall mounting brackets 22.

Each mounting structure 16 comprises a pair of bracing arms 26. Each bracing arm 26 is pivoted to a respective bracket 22 at pivot point A and to a respective upright outward support leg 28 at pivot point B. Each of the upper bed frame 12 and the lower bed frame 14 is pivotably affixed to or supported by mounting structure 16 by pivoted connection of its end rails 20 to a respective bracket 22 at pivot point C and to the outer support leg 28 at pivot point D.

Figure 2:
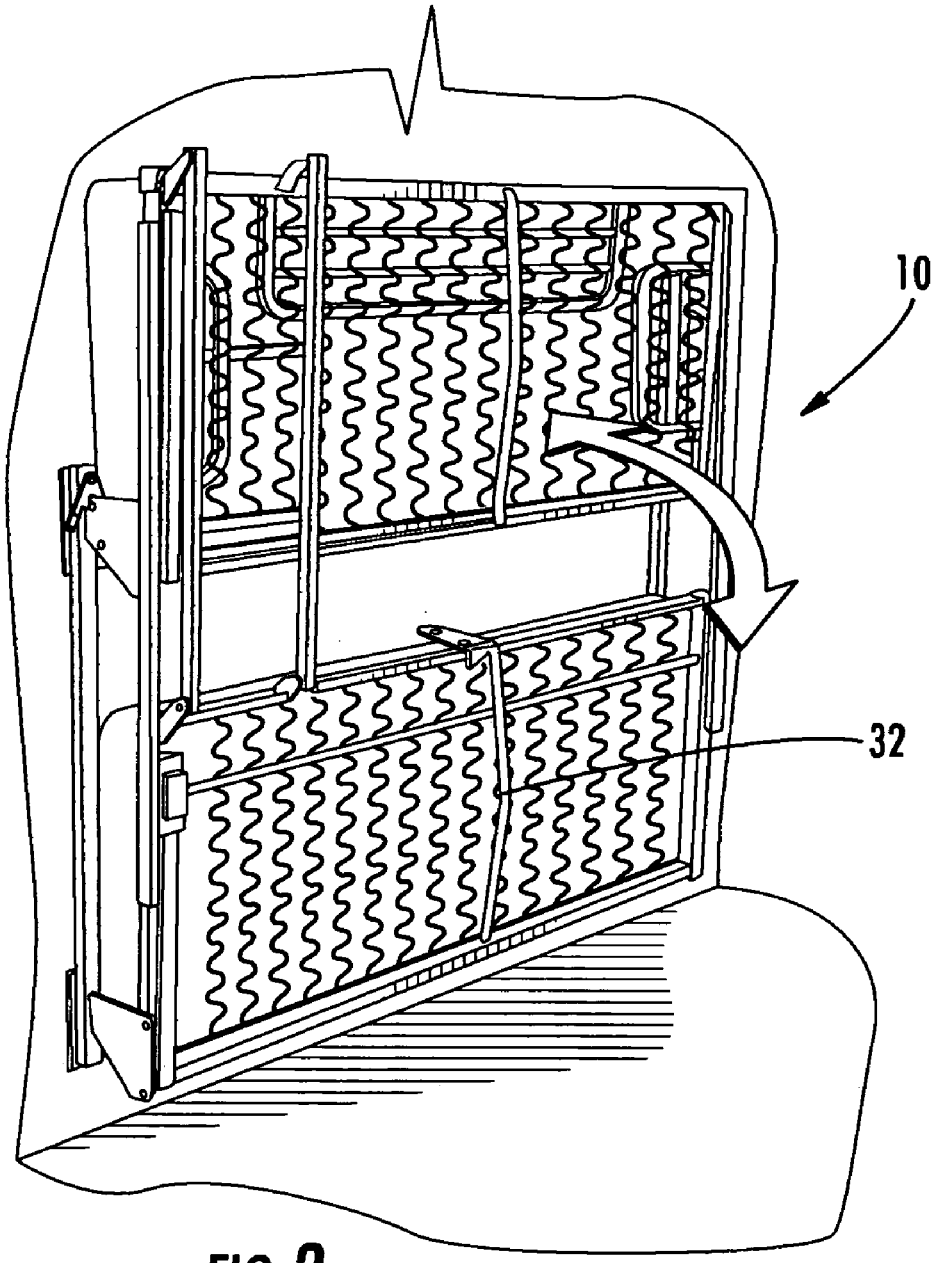
FIG. 2 is a perspective view of the foldable bed of the present invention folded against a supporting vertical wall.

As will therefore be understood, bunk bed structure 10 is adapted to fold and unfold in the following manner. The interconnection between wall mounting brackets 22, end rails 18, bracing arms 26 and outward support legs 28 form a parallelogram type of pivoted connection. The bunk bed structure 10 can pivot upwardly and downwardly relative to the wall W between a sleeping position (FIG. 1) and a storage position (FIG. 2).

In the sleeping position, each of the upper bed frame 12 and the lower bed frame 14 and bracing arms 26 are in a horizontal position extending perpendicularly outwardly from the wall W. The sleeping position is illustrated in FIG. 1. In the sleeping position, the outward support legs 28 are in vertical upright position engaging and supported by the floor F. In the storage position, each of the upper bed frame 12 and the lower bed frame 14 and bracing arms 26 are pivoted upward and in facing parallel relation to the wall W holding the mattress M in abutment against the wall with the outward support legs 28 elevated from the floor F and nested inwardly against the under side of the upper bed frame 12 and lower bed frame 14, respectively.

As shown in FIG. 1, bunk bed structure 10 has a guardrail 30. In particular, FIG. 1 illustrates the upper bed frame 12 having three guardrails 30. The guardrail of the present invention may be in hinged connection with the bedrails of the frame for pivoting movement of the guardrail 30 relative to the frame between an upright guard position wherein the guardrail 30 is angularly oriented relative to the frame and a nested position wherein the guardrail 30 is in flush abutment with the frame.

FIG. 1 also illustrates the three foldable guardrails 30 folded in a downward position (with upright position shown in broken lines).

The storage position of the bunk bed structure 10 and a means of securing the bunk bed structure 10 to the wall W are shown in FIG. 2. A preferred means for securing the bunk bed structure 10 to the wall W is a strap 32 that is removably attached to the wall W and the bed frame. The strap 32 can be of any material and have any type of closure. Preferably, the strap is of a hook and loop material such as VELCRO@.

Figure 3A:
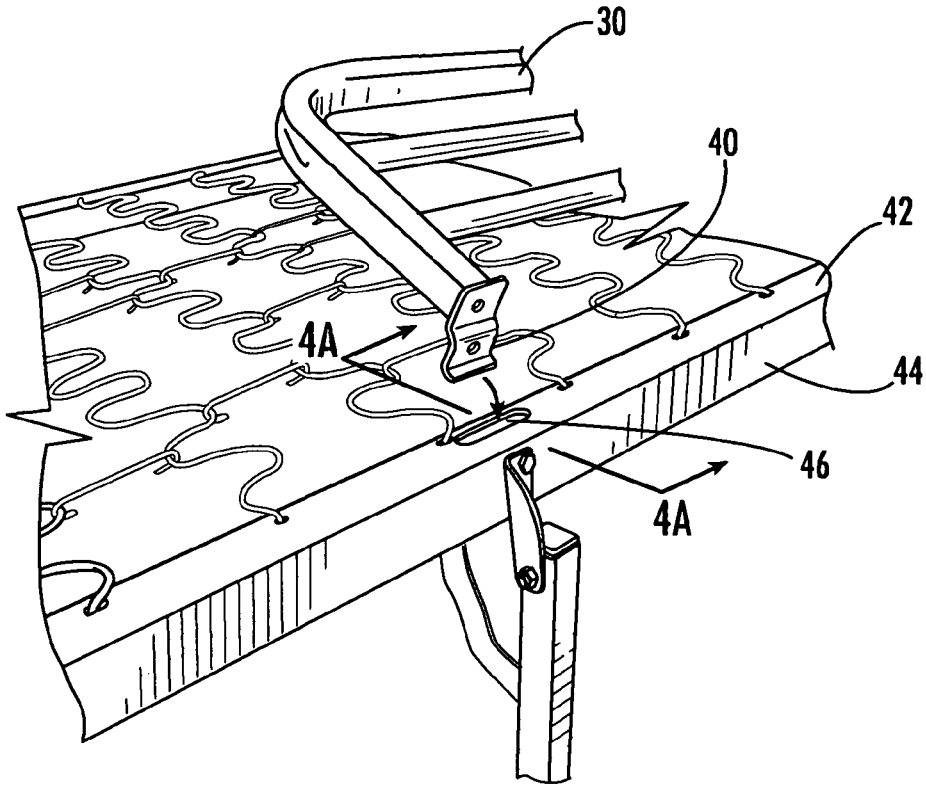
FIG. 3A is an exploded view of a guardrail having a mounting tab prior to insertion into a slot in the bedrail of the upper bed frame.
Figure 3B:
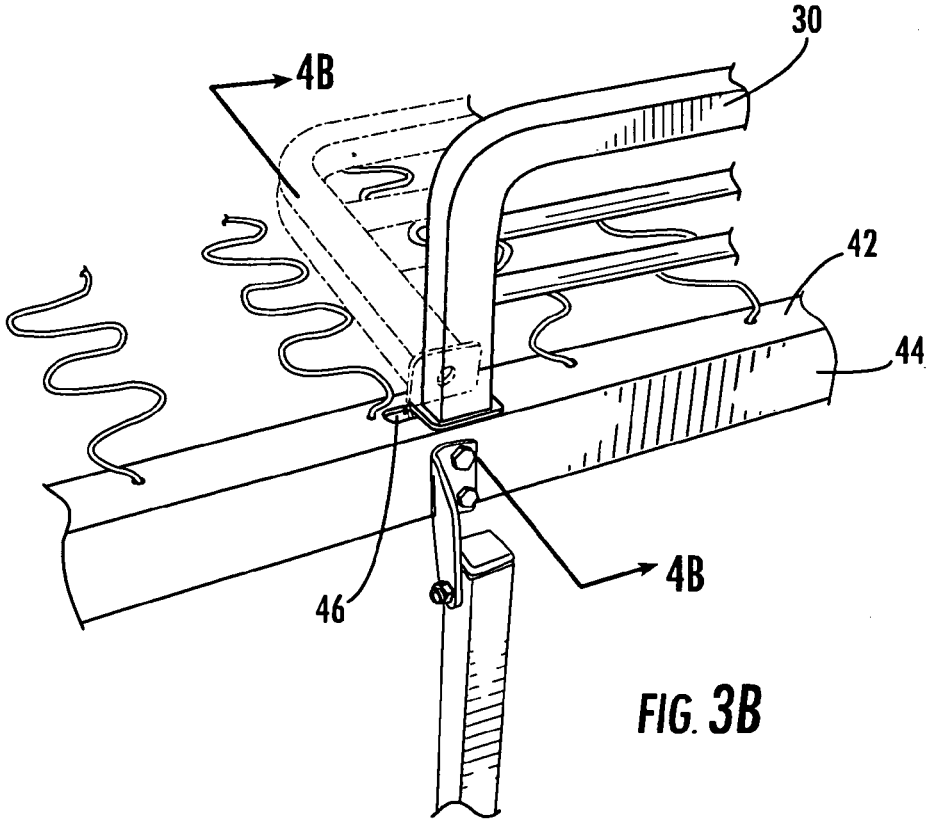
FIG. 3B is an assembled view of a guardrail having a mounting tab inserted into the slot in the bedrail of the upper bed frame, with the guardrail in the upright position.
Figure 4A:
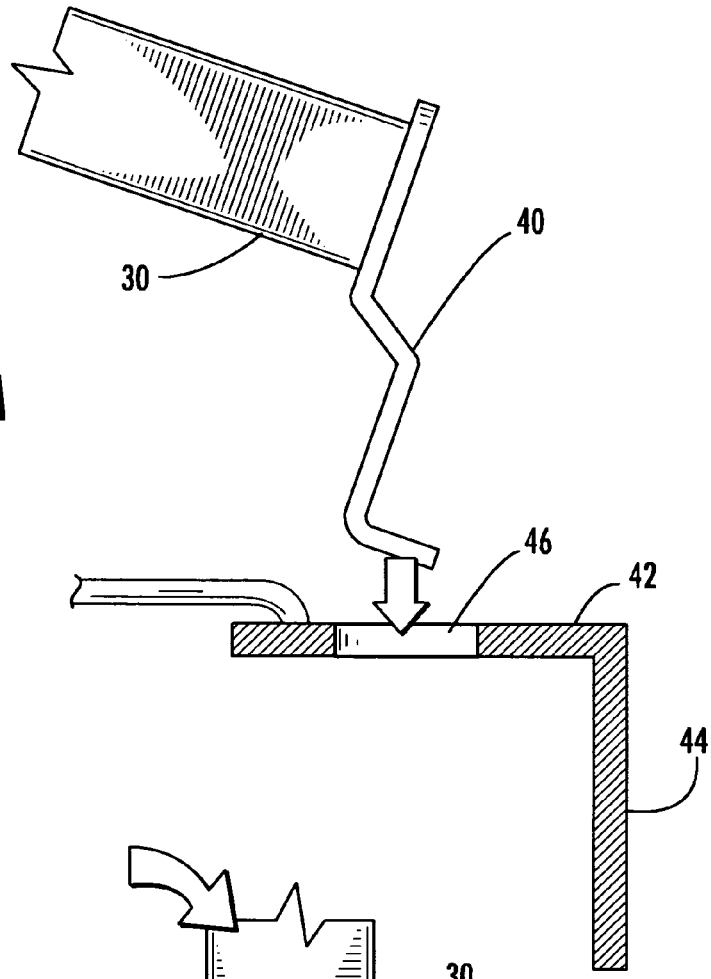
FIG. 4A is a cross-sectional view of the guardrail and bedrail of FIG. 3A.
Figure 4B:
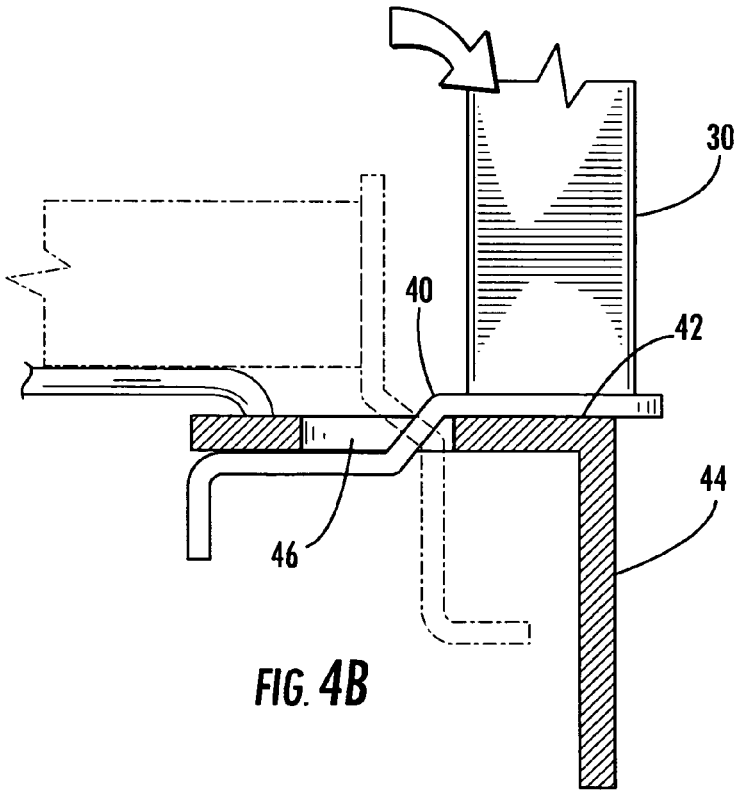
FIG. 4B is a cross-sectional view of the guardrail and bedrail of FIG. 3B.
Figure 5A:
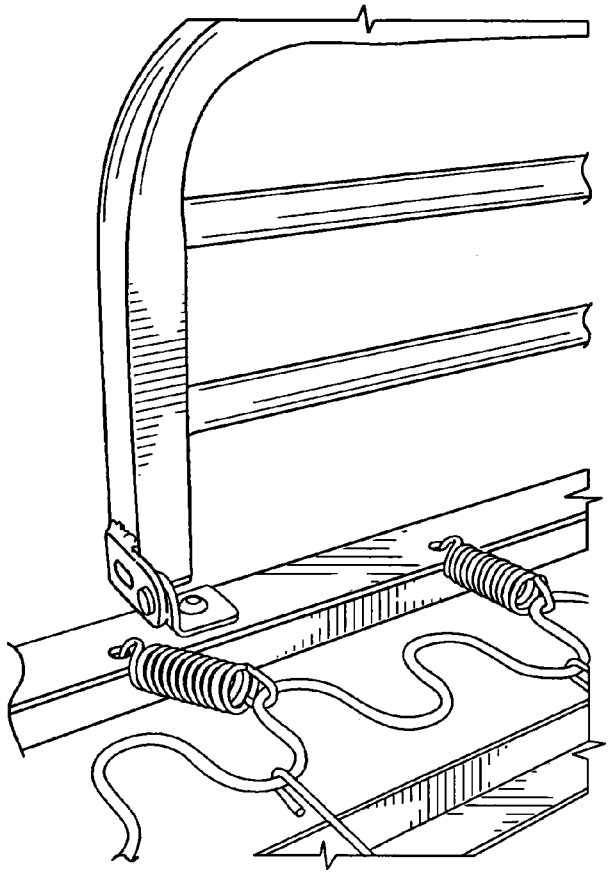
FIG. 5A is a perspective view of a guardrail in the upright position in accordance with the present invention.
Figure 5B:
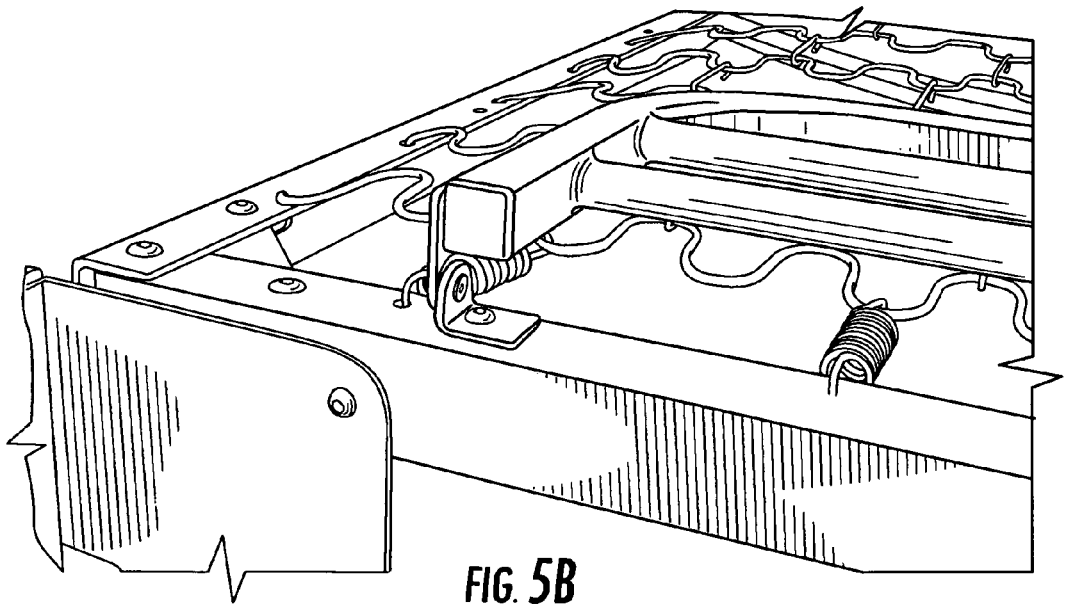
FIG. 5B is a perspective view of a guardrail in the downward position in accordance with the present invention.

In an embodiment of the present invention shown in FIG. 3A and FIG. 3B, each guardrail 30 has a mounting tab 40 and preferably a pair of such mounting tabs spaced apart from one another. Each of the side rails 18 and end rails 20 comprises a horizontal flange 42 and a vertical flange 44. Each of the side rails 18 and end rails 20 is typically formed from a single piece of material such as metal. The mattress M typically rests on and is supported by the horizontal flange 42 of each rail. A slot is formed in the horizontal flange 42 in correspondence to the mounting tab 40 of the guardrail 30. Each mounting tab 40 and its respective slot 46 are cooperatively configured for insertion and removal of the mounting tab 40 of the guardrail 30 into and out of the slot 46 and for pivoting movement of the guardrail 30 relative to the frame between an upright guard position wherein the guardrail 30 is angularly oriented relative to the frame and a nested position wherein the guardrail 30 is in flush abutment with the frame. In such nested position, the guardrails 30 may be conveniently stored beneath the mattress M when the bunk bed structure 10 is folded against the wall W in its storage position, as seen in FIGS. 1 and 2. FIG. 3B illustrates the guardrail 30 in the inserted upright position. FIGS. 4A and 4B illustrate cross-sectional views of the guardrail 30 in its uninserted and inserted positions, respectively. Hence, the guardrail 30 can be selectively inserted and detached from the rail of the bed frame. FIGS. 5A and 5B illustrate a guardrail, in its upright and downward positions respectively.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A foldable bed comprising:

a first frame for supporting a first mattress, foldable between a sleeping position and a storage position;

a second frame for supporting a second mattress, foldable between a sleeping position and a storage position;

a removable guardrail, of a size sufficient to prevent a user of the bed from rolling or falling out from the bed, having a mounting tab; and a slot in the first frame for insertion of the mounting tab of the guardrail into the first frame for pivoting movement of the guardrail relative to the first frame between an upright guard position wherein the guardrail is angularly oriented relative to the first frame and a nested position wherein the guardrail is in flush abutment with the first frame.

2. The foldable bed as claimed in claim 1, wherein the foldable bed is mounted to a supporting vertical wall.

3. The foldable bed as claimed in claim 2, wherein the foldable bed is moveable between a storage position pivoted vertically alongside the supporting vertical wall and a sleeping position pivoted horizontally from the supporting vertical wall.

4. The foldable bed as claimed in claim 1, wherein the mounting tab of the guardrail and the slot of the first frame are cooperatively configured for attachment of the guardrail to the first frame and detachment of the guardrail from the first frame.

5. The foldable bed as claimed in claim 1, wherein the foldable bed has two guardrails.

6. The foldable bed as claimed in claim 1, wherein the foldable bed has three guardrails.

7. The foldable bed as claimed in claim 1, wherein the guardrail has two mounting tabs.

8. The foldable bed as claimed in claim 1, wherein the foldable bed has two slots in the first frame.

9. The foldable bed as claimed in claim 1, wherein the foldable bed has four slots in the first frame.

10. The foldable bed as claimed in claim 1, wherein the foldable bed has six slots in the first frame.

11. A bunk bed comprising:

an upper frame, foldable between a sleeping position and a storage position;

a lower frame, foldable between a sleeping position and a storage position;

a removable guardrail, of a size sufficient to prevent a user of the bed from rolling or falling out from the bed, on the upper frame having a mounting tab; and a slot in the upper frame for insertion of the mounting tab of the guardrail into the upper frame for pivoting movement of the guardrail relative to the frame between an upright guard position wherein the guardrail is angularly oriented relative to the upper frame and a nested position wherein the guardrail is in flush abutment with the upper frame.

12. The bunk bed as claimed in claim 11, wherein the bunk bed is mounted to a supporting vertical wall.

13. The bunk bed as claimed in claim 12, wherein the bunk bed is moveable between a storage position pivoted vertically alongside the supporting vertical wall and a sleeping position pivoted horizontally from the supporting vertical wall.

14. The bunk bed as claimed in claim 11, wherein the mounting tab of the guardrail and the slot of the upper frame are cooperatively configured for attachment of the guardrail to the upper frame and detachment of the guardrail from the upper frame.

15. The bunk bed as claimed in claim 11, further comprising a guardrail on the lower frame and a slot in the lower frame for insertion of the guardrail into the lower frame for pivoting movement of the guardrail relative to the frame between an upright guard position wherein the guardrail is angularly oriented relative to the lower frame and a nested position wherein the guardrail is in flush abutment with the lower frame.

16. The bunk bed as claimed in claim 11, wherein the bunk bed has two guardrails.

17. The bunk bed as claimed in claim 11, wherein the bunk bed has three guardrails.

18. The bunk bed as claimed in claim 11, wherein the guardrail has two mounting tabs.

19. The bunk bed as claimed in claim 11, wherein the bunk bed has two slots in the upper frame.

20. The bunk bed as claimed in claim 11, wherein the bunk bed has four slots in the upper frame.

21. The bunk bed as claimed in claim 11, wherein the bunk bed has six slots in the upper frame.

* * * * *